US007549704B1

(12) United States Patent
Chou et al.

(10) Patent No.: US 7,549,704 B1
(45) Date of Patent: Jun. 23, 2009

(54) HEADREST ADJUSTING STRUCTURE FOR A SEAT

(76) Inventors: Kuo-Ching Chou, No. 29-10, Nioujhuang, Shanhua Township, Tainan County 741 (TW); Ding-Kuo Chou, No. 29-10, Nioujhuang, Shanhua Township, Tainan County 741 (TW)

( * ) Notice: Subject to any disclaimer, the term of this patent is extended or adjusted under 35 U.S.C. 154(b) by 0 days.

(21) Appl. No.: 12/033,926

(22) Filed: Feb. 20, 2008

(51) Int. Cl.
*A47C 7/38* (2006.01)
*A47C 7/36* (2006.01)

(52) U.S. Cl. ..... 297/408

(58) Field of Classification Search ..... 297/408, 297/397, 399, 400
See application file for complete search history.

(56) References Cited

U.S. PATENT DOCUMENTS 602,625 A * 4/1898 La Fave ..... 74/551.4
3,692,356 A * 9/1972 Mertens ..... 297/408
3,761,128 A * 9/1973 Schenk et al. ..... 297/408
4,335,920 A * 6/1982 Hirth ..... 297/408
5,180,207 A * 1/1993 Schmidt ..... 297/408
6,702,385 B2 * 3/2004 Holdampf et al. ..... 297/408
6,857,704 B2 * 2/2005 Stenzel et al. ..... 297/408
6,899,395 B2 * 5/2005 Yetukuri et al. ..... 397/408
7,055,909 B2 * 6/2006 Wu ..... 297/408
7,093,313 B2 * 8/2006 DeBraal et al. ..... 297/408 X

* cited by examiner

*Primary Examiner*—Rodney B White
(74) *Attorney, Agent, or Firm*—Alan Kamrath; Kamrath & Associates PA

(57) ABSTRACT

A headrest adjusting structure for a seat comprises a base and a rotating support. The base is formed with a groove for receiving a supporting portion of the rotating support which has outwardly cavities. The base has outwardly accommodating spaces which is formed with an aperture for receiving a ball and resilient element on two sides. Each ball has an end engageable with the corresponding recess on the positioning disk mounted in the rotating support. A threaded fastener can penetrate the pressing plates fitted in the accommodating spaces of the base, the base and the supporting portion of the rotating support, and be screwed into a nut to hold together. A cap is mounted on each accommodating space of the base. A headrest which is combined at the headrest adjusting assembly installed on a seat can be adjusted to a preferred position by manually pulling the rotating support easily.

4 Claims, 7 Drawing Sheets

HEADREST ADJUSTING STRUCTURE FOR A SEAT

BACKGROUND OF THE INVENTION

1. Technical Field

The present invention relates to a headrest adjusting structure for a seat, and more particularly, to a headrest adjusting structure installed at an upper end of a seat designed for comfortable sitting, wherein a headrest combined at an end of the headrest adjusting structure can be easily adjusted to a preferred position and angle by operating the headrest adjusting structure.

2. Description of Related Art

Nowadays, seats available on the market are designed not only for a user to simply sit in or on for a rest, but also to put his or her head on a headrest extending from an upper end of the seat, so that the user can sit more comfortably in or on the seat with his or her head supported by the headrest. However, such a headrest is usually extending from an upper end of a seat at a single and fixed angle and cannot be adjusted to a desired angle or height according to the head positions of different users.

SUMMARY OF THE INVENTION

In view of the inconvenience associated with use of existing headrests installed on an upper end of a seat, the present invention provides an improvement in which a headrest installed at an upper end of a seat can be adjusted in position and angle as needed by a simple operation.

A first objective of the present invention is to provide a headrest adjusting structure for a seat comprising a base and a rotating support. The base is formed with a groove for receiving a supporting portion formed at a first end of the rotating support, wherein the supporting portion has outwardly opening cavities, each of which can receive and retain a positioning disk having a plurality of recesses on a side surface thereof and at least one protrusion on a periphery of the positioning disk for engaging with a corresponding dent formed on the supporting portion. The base further has outwardly opening accommodating spaces on two sides thereof respectively, wherein each of the accommodating spaces is formed with an aperture on a surface thereof for receiving a ball and a resilient element. Each of the balls has an end engageable in the corresponding recess on the corresponding positioning disk mounted in the rotating support while a pressing plate is fitted in each of the accommodating spaces to retain the resilient element and the ball. A threaded fastener can be penetratingly coupled with the pressing plates fitted in the accommodating spaces on the two sides of the base, the base and the supporting portion formed at the end of the rotating support, and be further combined with a nut to position and hold together the pressing plates, the base and the supporting portion. In addition, an outer cap is mounted on each of the accommodating spaces formed on the two sides of the base. A headrest adjusting assembly thus formed can be installed on a seat so that a headrest combined to an end of the headrest adjusting assembly can be easily adjusted to a preferred position by manually pulling the rotating support.

A second objective of the present invention is to provide the aforesaid headrest adjusting structure for the seat, wherein the supporting portion formed at the first end of the rotating support and pivotally received in the base is provided with one or two outwardly opening cavities on one or both of the two sides thereof for receiving the corresponding one or two positioning disks, respectively.

A third objective of the present invention is to provide the aforesaid headrest adjusting structure for the seat, wherein the outwardly opening accommodating spaces formed on the two sides of the base, respectively, are each provided on the surface thereof with one or more said apertures for receiving the corresponding one ball and one resilient element or more than one said ball and more than one said resilient element, respectively.

BRIEF DESCRIPTION OF THE DRAWINGS

The invention as well as a preferred mode of use, further objectives and advantages thereof will best be understood by reference to the following detailed description of an illustrative embodiment when read in conjunction with the accompanying drawings, wherein.

DETAILED DESCRIPTION OF THE PREFERRED EMBODIMENT

Figure 1:
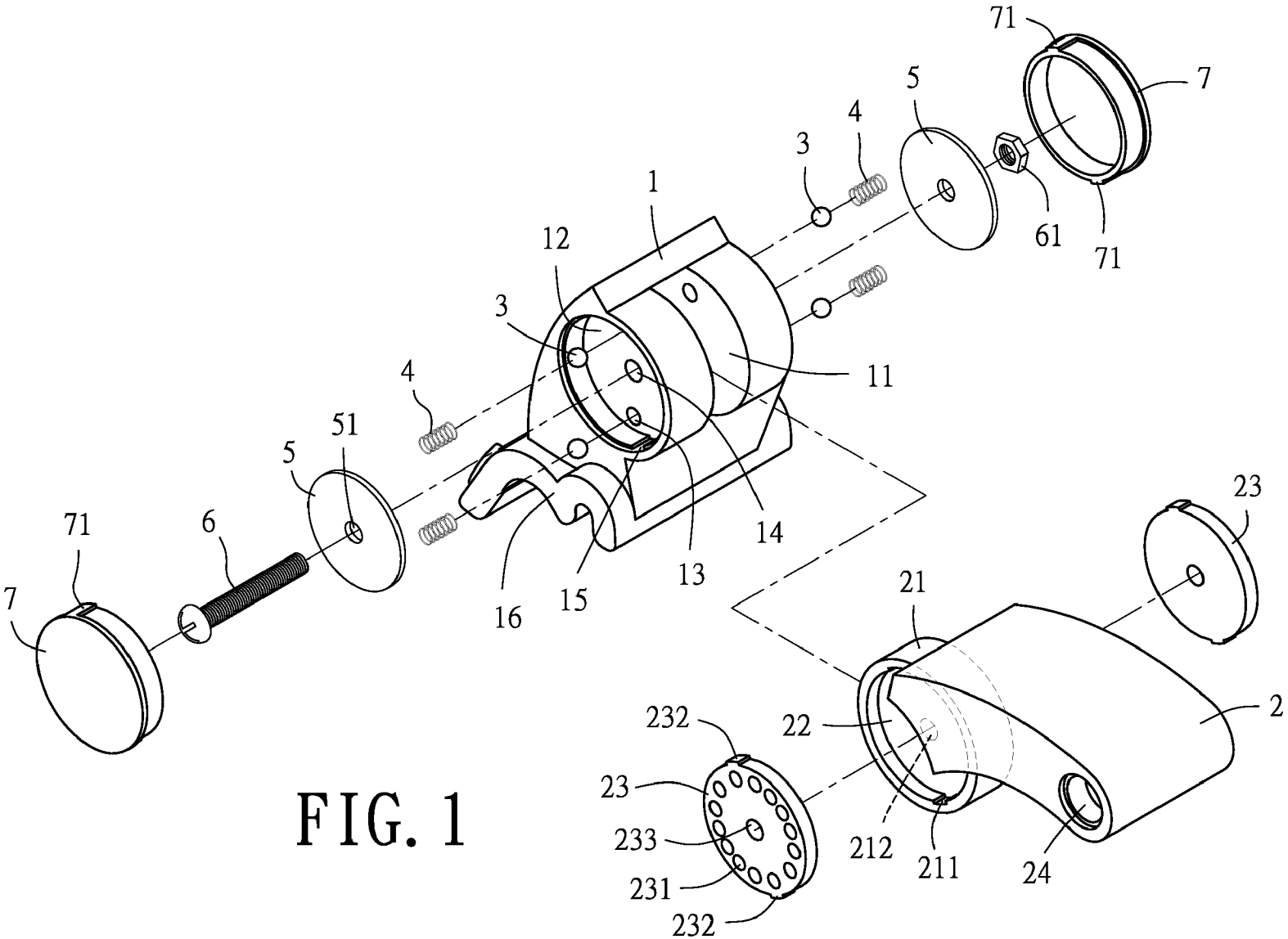
FIG. 1 is a perspective exploded view of a headrest adjusting assembly according to the present invention.

Referring to FIG. 1, a headrest adjusting structure for a seat according to the present invention comprises a base 1 and a rotating support 2 which form a headrest adjusting assembly 8.

The base 1 is formed with a groove 11 and has outwardly opening accommodating spaces 12 on two sides of the base 1, respectively, wherein each of the accommodating spaces 12 is provided on a surface thereof with apertures 13 for each receiving a ball 3 and a resilient element 4. (In this embodiment, two apertures 13 are provided on the surface of each said accommodating space 12, although there can be only one or more than two apertures 13 on the surface of each said accommodating space 12.) A pressing plate 5 is fitted in each of the accommodating spaces 12 for retaining the corresponding resilient elements 4 and balls 3. The base 1 has a through hole 14 in a center thereof so that a threaded fastener 6 can penetrate a hole 51 on each of the pressing plates 5 fitted in the accommodating spaces 12 on the two sides of the base 1 and the through hole 14 of the base 1, and be further combined with and retained by a nut 61 at an end of the threaded fastener 6. The accommodating spaces 12 on the two sides of the base 1 are each provided on a periphery thereof with at least one notch 15 for engaging with at least one projection 71 on a periphery of an outer cap 7. In addition, the base 1 has a lower side formed with an engaging portion 16 adaptive to a form of an upper end of a seat for being installed stably on the upper end of the seat.

The rotating support 2 is formed with a supporting portion 21 at a first end thereof for being received in the groove 11 of the base 1, wherein the supporting portion 21 has outwardly opening cavities 22, each of which can receive a positioning disk 23 having a plurality of recesses 231 on a side surface thereof. (While there can be only one such cavity 22 in the supporting portion 21 or two such cavities 22 provided on each of two sides of the supporting portion 21, respectively, two cavities 22 are provided in this embodiment.) Each of the positioning disks 23 has at least one protrusion 232 for engaging with a corresponding dent 211 formed on the supporting portion 21. The supporting portion 21 and the positioning disks 23 are formed with bores 212 and 233, respectively, while an axial hole 24 is formed at a second end of the rotating support 2 opposite the supporting portion 21 for being assembled with a headrest component.

Figure 2:
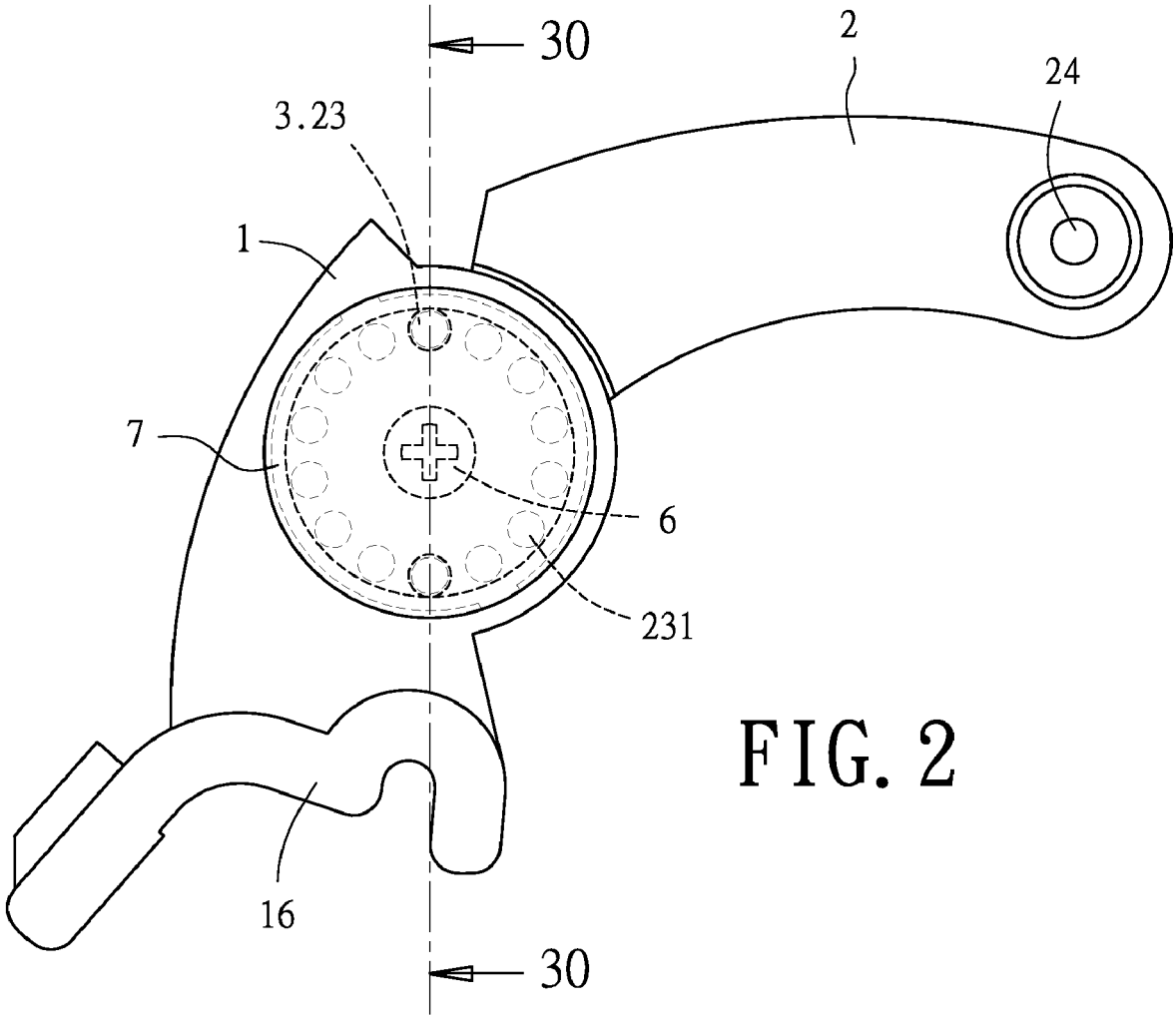
FIG. 2 is a schematic side view of the headrest adjusting assembly according to the present invention.
Figure 3:
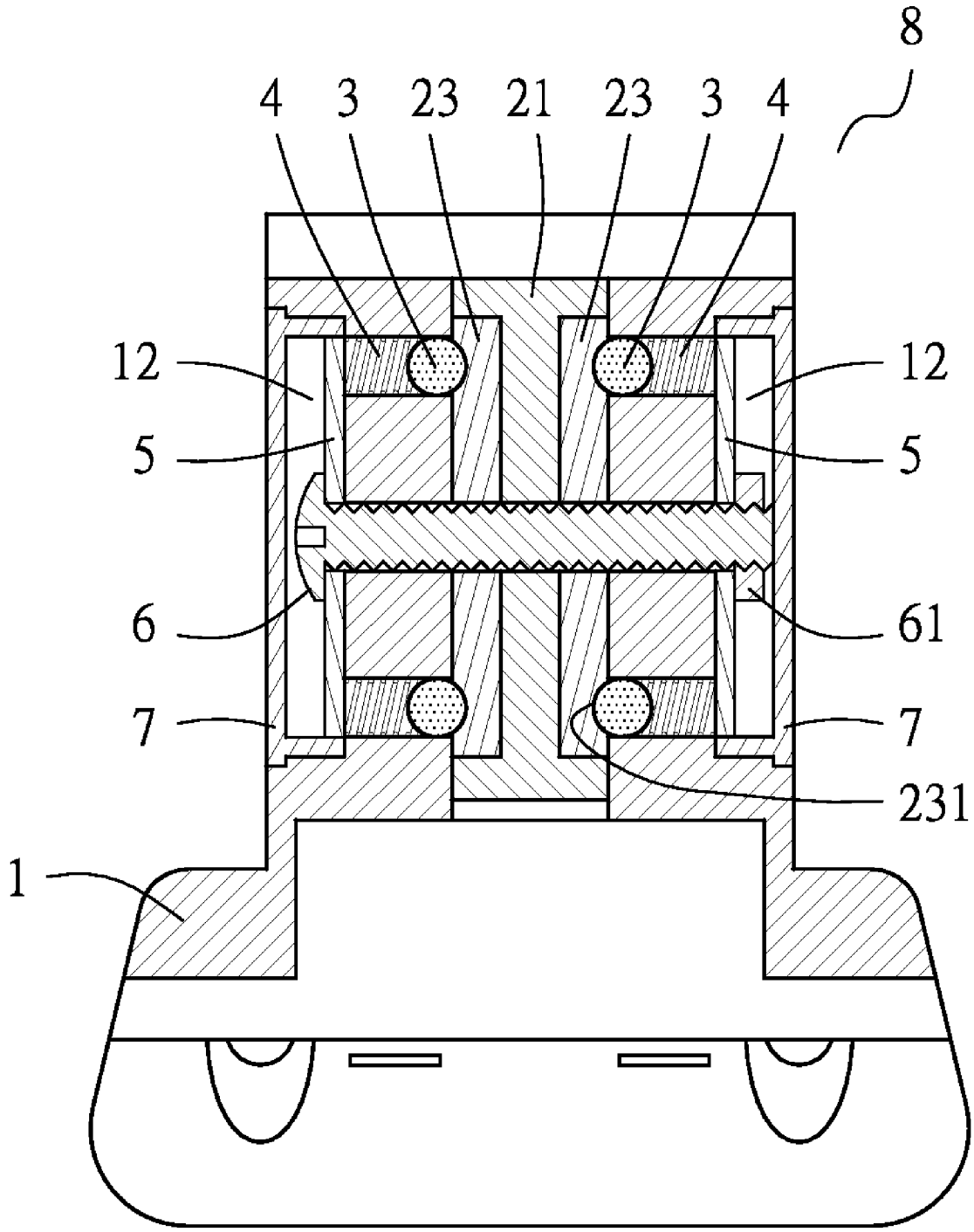
FIG. 3 is a cross-sectional view taken along a line 30-30 in FIG. 2.

Referring to FIGS. 1 to 3, when the base 1 is to be assembled with the rotating support 2, the positioning disks 23 are fitted respectively into the cavities 22 formed on the supporting portion 21 of the rotating support 2. Then, the supporting portion 21 is inserted into the groove 11 of the base 1. Next, the balls 3 and the resilient elements 4 are put into the corresponding apertures 13 provided on the surface of each of the accommodating spaces 12 formed on the two sides of the base 1, so that an end of each of the balls 3 which are constantly biased outwards by the corresponding resilient elements 4 are engaged in the corresponding recess 231 on the corresponding positioning disk 23, while the resilient elements 4 and the balls 3 are retained by the corresponding pressing plates 5. Following that, the threaded fastener 6 is passed through and combined with the pressing plates 5 fitted in the accommodating spaces 12 formed on the two sides of the base 1, the base 1, and the supporting portion 21 formed at the first end of the rotating support 2. The threaded fastener 6 is further combined with and retained by the nut 61 to position and hold together the pressing plates 5, the base 1, and the supporting portion 21. Finally, the accommodating spaces 12 formed on the two sides of the base 1 are covered with the outer caps 7, respectively, to form the headrest adjusting assembly 8.

Figure 4:
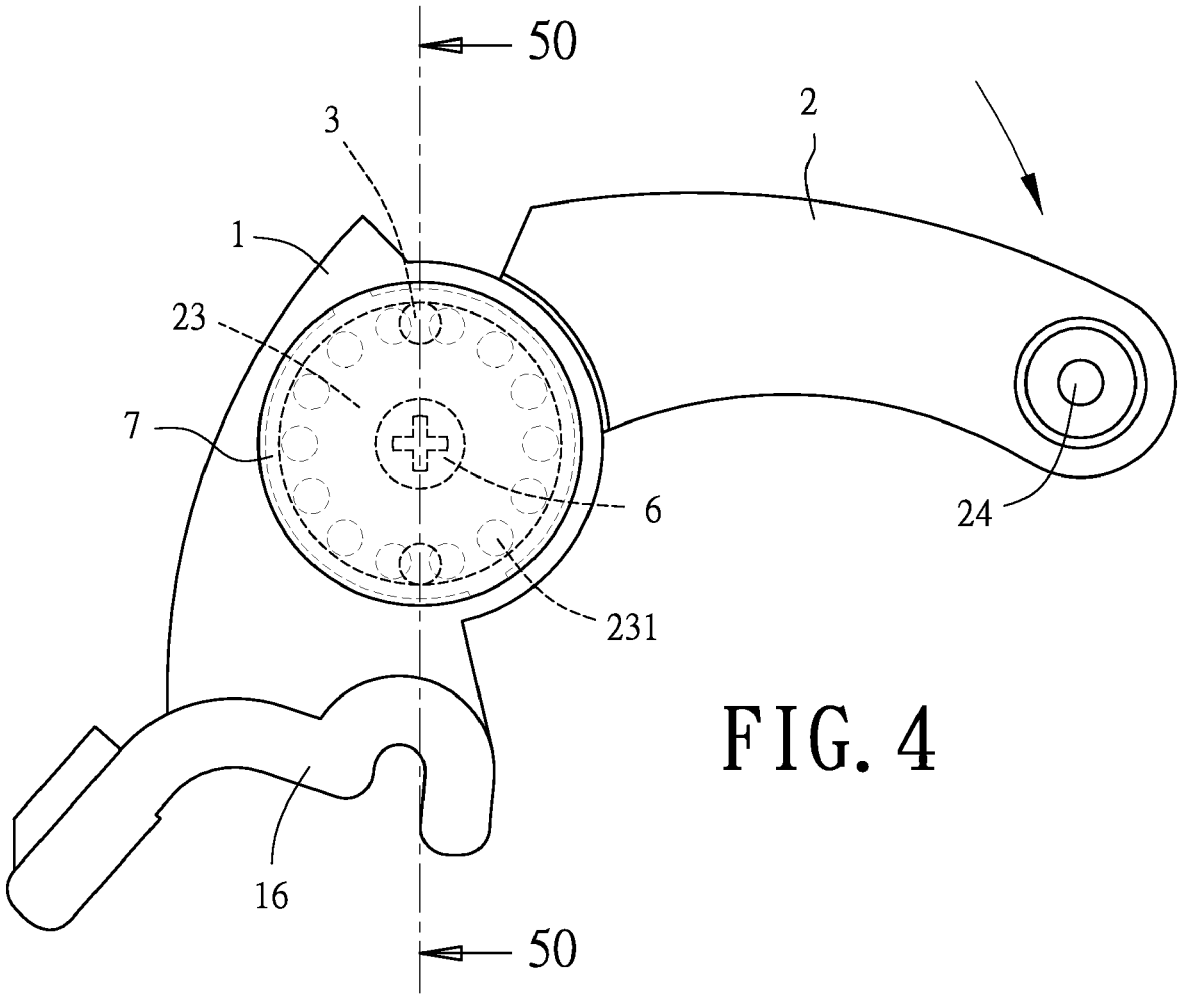
FIG. 4 illustrates a downward movement of a rotating support of the headrest adjusting assembly according to the present invention.
Figure 5:
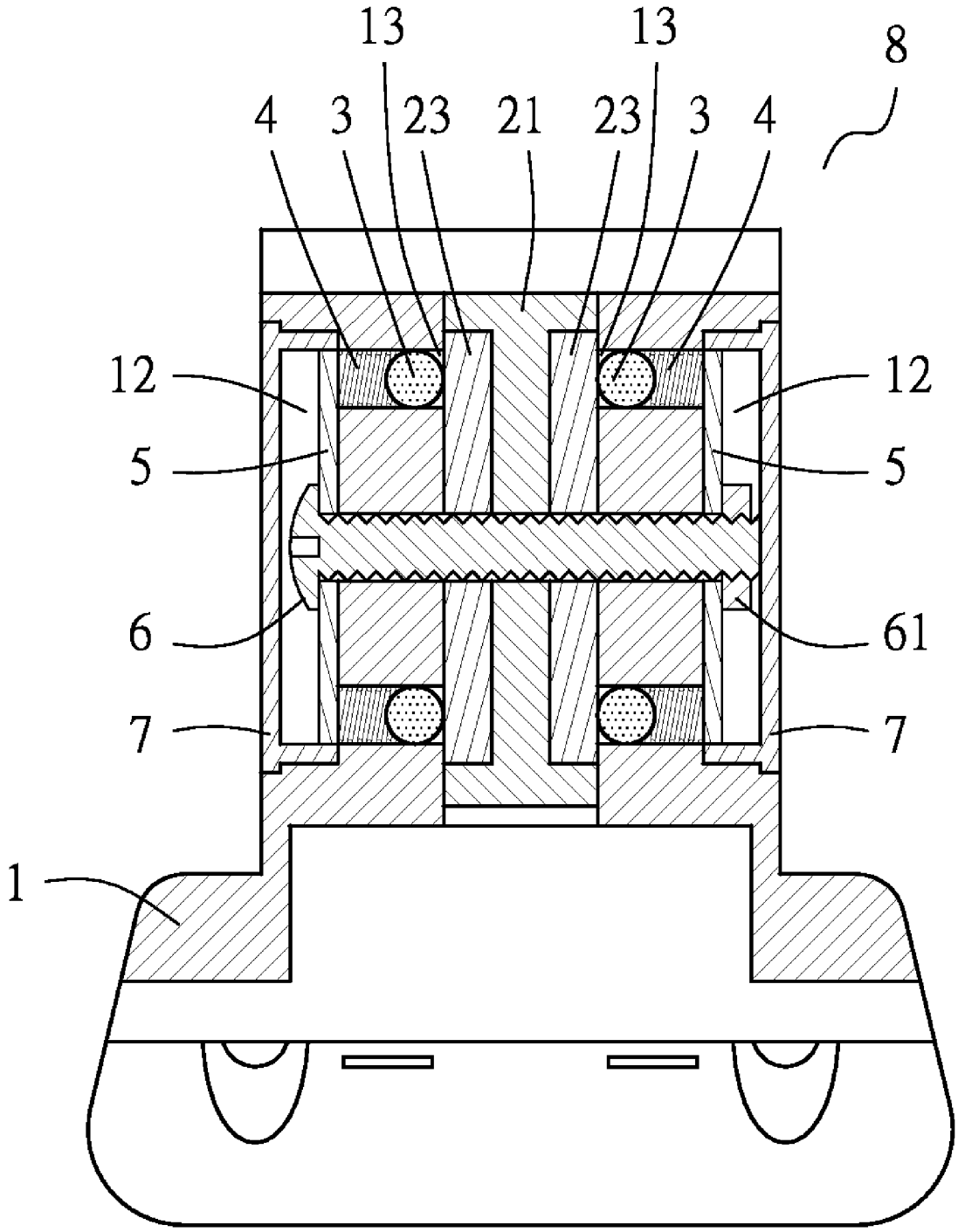
FIG. 5 is a cross-sectional view taken along a line 50-50 in FIG. 4.
Figure 6:
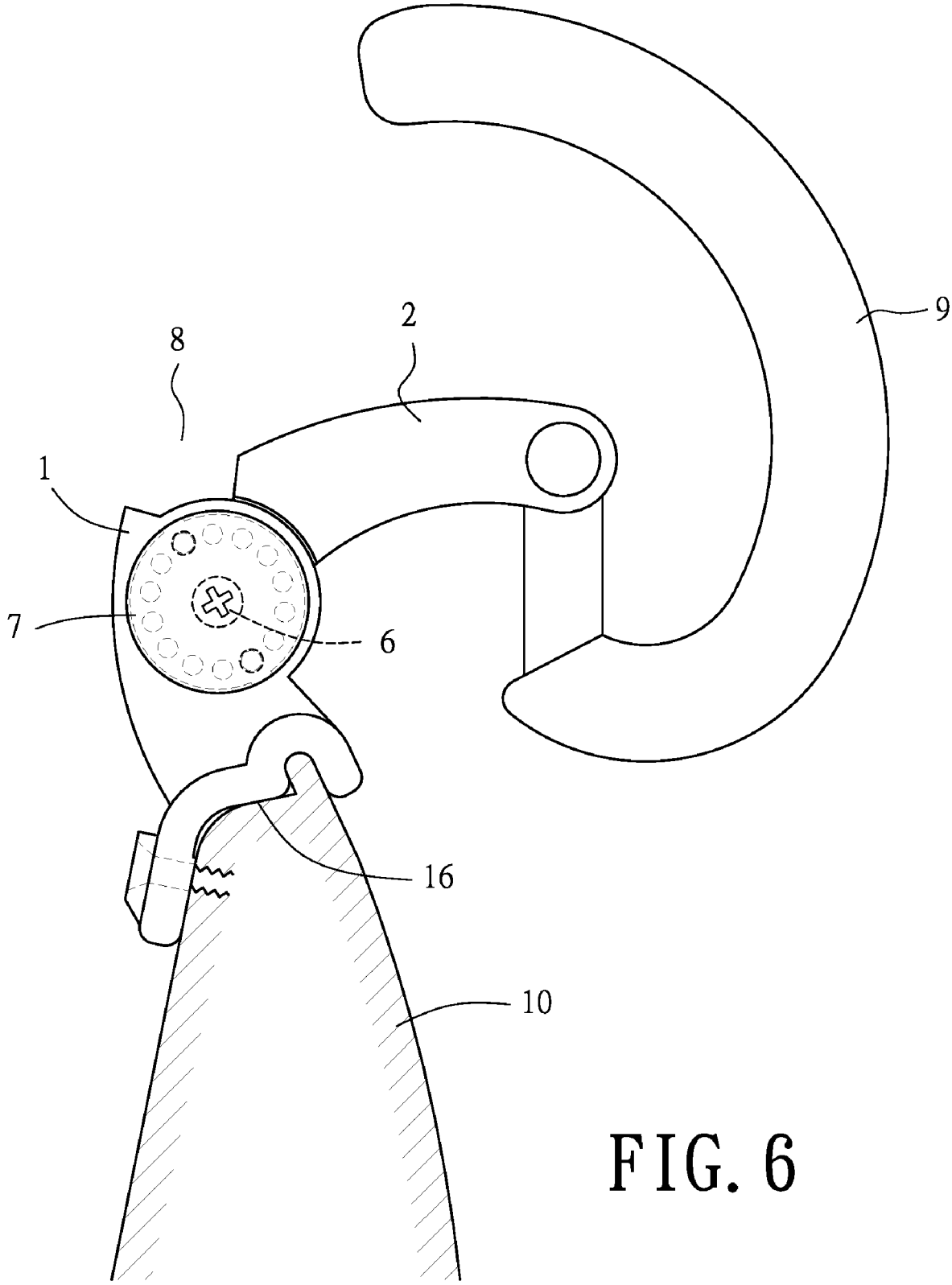
FIG. 6 illustrates the headrest adjusting assembly according to the present invention, wherein a headrest combined to an end of the rotating support is adjusted to a relatively high position.
Figure 7:
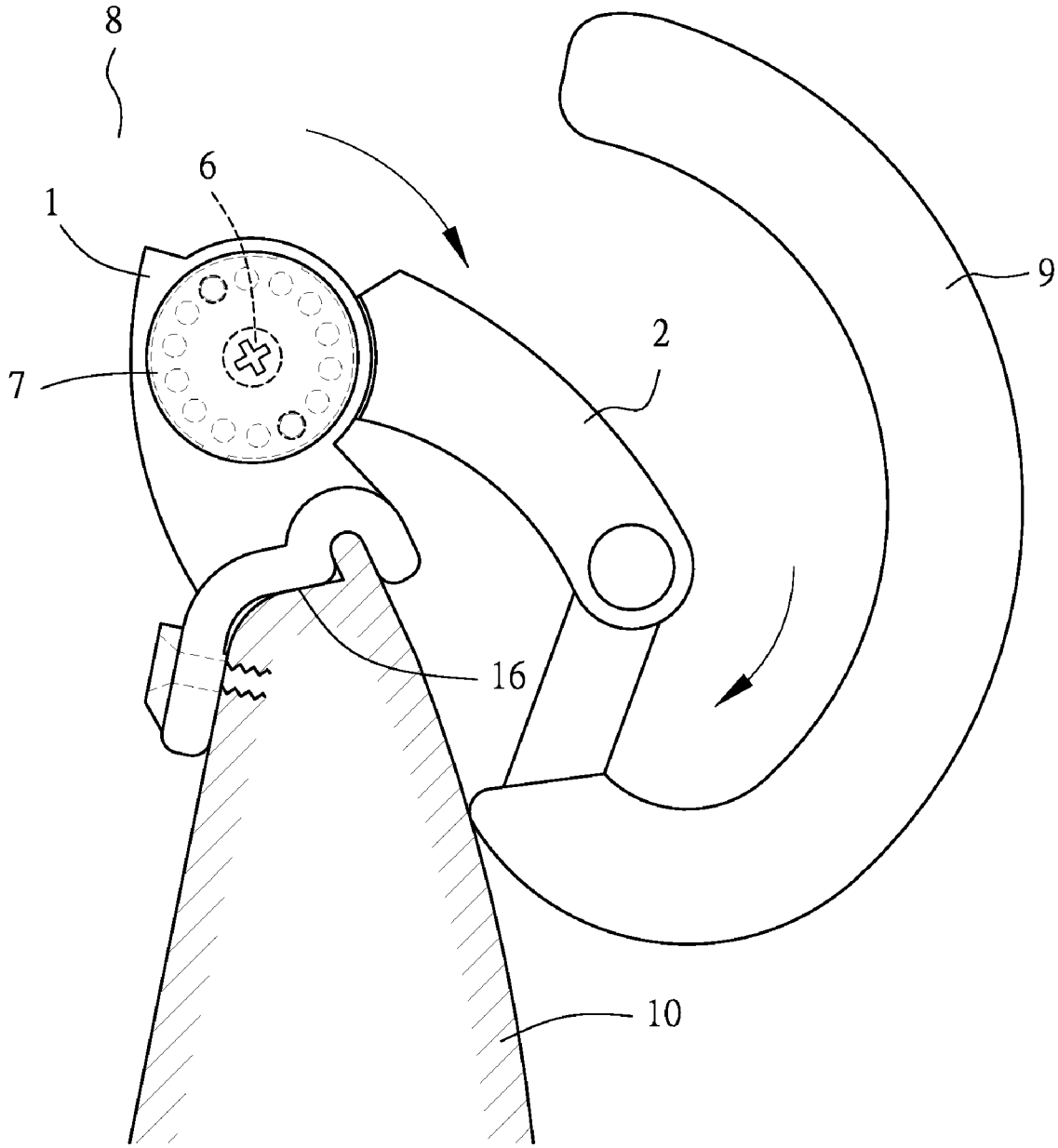
FIG. 7 illustrates the headrest adjusting assembly according to the present invention, wherein the headrest combined to the end of the rotating support is adjusted to a relatively low position.

Referring to FIG. 6, a headrest 9 is combined with the axial hole 24 formed at the second end of the rotating support 2 while the engaging portion 16 formed on the base 1 of the headrest adjusting assembly 8 is installed on an upper end of a back 10 of a seat. Referring to FIG. 4, when the headrest adjusting assembly 8 combined with the headrest 9 is in use, a person who sits in or on the seat and wishes to adjust the headrest 9 to a more comfortable angle can do so by manually pulling the rotating support 2 so that the supporting portion 21 formed on the first end of the rotating support 2 and the positioning disks 23 fitted in the supporting portion 21 are rotated simultaneously. As a result while the positioning disks 23 are being rotated, the outwardly biased balls 3 embedded in the apertures 13 provided on the surfaces of the accommodating spaces 12 formed on the two sides of the base 1 are pressed inwards by the positioning disks 23, as shown in FIG. 5, thereby bringing the rotating support 2 into a free state, in which the user is allowed to adjust the rotating support 2 combined with the headrest 9 at the second end thereof to a desired angle and position (such as a relatively high and upward position shown in FIG. 6 or a relatively low and downward position shown in FIG. 7).

When the rotating support 2 with the headrest 9 reaches a preset position, a slight jog by the user will bring the outwardly biased balls 3 embedded in the apertures 13 provided on the surfaces of the accommodating spaces 12 formed on the two sides of the base 1 once again into engagement with the corresponding recesses 231 formed on the positioning disks 23 fitted in the supporting portion 21, as shown in FIG. 3, thereby restricting a relative position between the rotating support 2 and the base 1. Thus, the headrest adjusting assembly 8 installed on the upper end of the seat allows the headrest 9 combined at the end of the headrest adjusting assembly 8 to be easily adjusted as needed to a preferred position by manually pulling the rotating support 2.

What is claimed is:

1. A headrest adjusting structure for a seat, comprising a headrest adjusting assembly to be combined with a headrest and installed on an upper end of the seat and characterized in:

the headrest adjusting assembly comprising a base and a rotating support, wherein the base is formed with a groove for receiving a supporting portion formed at an end of the rotating support, and the supporting portion has outwardly opening cavities, each of which can receive therein a positioning disk having a plurality of recesses on a side surface thereof and at least one protrusion on a periphery of the positioning disk for engaging with a corresponding dent formed on the supporting portion;

the base further having outwardly opening accommodating spaces on two sides thereof, respectively, wherein each of the accommodating spaces is formed with an aperture on a surface thereof for receiving a ball and a resilient element, in which each of the balls has an end engageable in one of the recesses on one of the positioning disks mounted in the rotating support while a pressing plate is fitted in each of the accommodating spaces to retain the resilient element and the ball, a threaded fastener being penetratingly coupled with the pressing plates fitted in the accommodating spaces on the two sides of the base, the base and the supporting portion formed at one end of the rotating support, and further combined with a nut to position and hold together the pressing plates, the base and the supporting portion; and an outer cap being mounted on each of the accommodating spaces formed on the two sides of the base; and a headrest adjusting assembly thus formed being installed on the seat so that the headrest combined to an end of the headrest adjusting assembly can be easily adjusted to a preferred position by manually pulling the rotating support.

2. The headrest adjusting structure as claimed in claim 1, wherein the supporting portion formed at the one end of the rotating support and pivotally received in the base has an outwardly opening cavity on one or both of the two sides thereof for receiving the corresponding one or two positioning disks, respectively.

3. The headrest adjusting structure as claimed in claim 1, wherein the outwardly opening accommodating spaces formed on the two sides of the base are each provided on the surface thereof with one or more said apertures for receiving the corresponding one ball and one resilient element or more than one said ball and more than one said resilient element, respectively.

4. The headrest adjusting structure as claimed in claim 1, wherein the outer caps covering the accommodating spaces formed on the two sides of the base are each provided on a periphery thereof with at least one projection for engaging with at least one notch on a periphery of the corresponding accommodating space.

* * * * *